United States Patent [19]

Fortune

[11] 4,436,355

[45] Mar. 13, 1984

[54] MODULAR STORAGE SYSTEM

[76] Inventor: William S. Fortune, 29866 Cuthbert St., Malibu, Calif. 90265

[21] Appl. No.: 259,615

[22] Filed: May 1, 1981

Related U.S. Application Data

[63] Continuation of Ser. No. 67,841, Aug. 20, 1979.

[51] Int. Cl.[3] ..... A47B 88/00; F16B 12/00

[52] U.S. Cl. ..... 312/270; 312/111; 312/320; 312/330 R

[58] Field of Search ..... 312/270, 111, 273, 107.5, 312/215, 216, 108, 330 R, 320, 12, 9, 13; 108/61; 248/224.1

[56] References Cited

U.S. PATENT DOCUMENTS

| | | | |
|---|---|---|---|
| 1,340,562 | 5/1920 | Sandmann | 312/108 |
| 2,245,026 | 6/1941 | Balkind | 312/111 |
| 2,245,415 | 6/1941 | Runko | 312/273 |
| 2,386,343 | 10/1945 | Regenhardt | 312/111 |
| 2,482,174 | 9/1949 | Hake | 312/330 R |
| 2,729,529 | 1/1956 | Hoven et al. | 312/245 |
| 2,733,112 | 1/1956 | Dunham | 312/111 |
| 2,807,387 | 9/1957 | Siciliano | 312/111 |
| 2,967,080 | 1/1961 | Nelson | 312/216 |
| 2,988,411 | 6/1961 | Vannice | 312/111 |
| 3,025,122 | 3/1962 | Millman | 312/245 |
| 3,030,163 | 4/1962 | Gottsegen | 312/111 |
| 3,193,342 | 7/1965 | Sauter | 312/320 |
| 3,287,075 | 11/1966 | Batke et al. | 312/111 |
| 3,554,625 | 1/1971 | Sly, Sr. | 312/330 R |
| 3,563,624 | 2/1971 | Stice | 312/111 |
| 3,567,298 | 3/1971 | Ambaum et al. | 312/111 |
| 3,604,775 | 9/1971 | Anderson | 312/330 R |
| 3,680,177 | 8/1972 | Ginsberg | 312/330 R |
| 3,712,696 | 1/1973 | McDonnell | 312/270 |
| 3,779,623 | 12/1973 | Motohashi | 312/108 |
| 3,918,781 | 11/1975 | Paris | 312/111 |
| 3,974,898 | 8/1976 | Tullis et al. | 312/111 |
| 4,002,387 | 1/1977 | Wolbrink | 312/270 |
| 4,026,615 | 5/1977 | Tazaki et al. | 312/12 |
| 4,105,270 | 8/1978 | Bergkamp et al. | 312/330 R |
| 4,132,380 | 1/1979 | Pasture | 248/224.1 |
| 4,140,355 | 2/1979 | Swain | 312/330 R |
| 4,227,758 | 10/1980 | Clare | 312/111 |

FOREIGN PATENT DOCUMENTS

| | | | |
|---|---|---|---|
| 578675 | 6/1959 | Canada | 312/111 |
| 1125609 | 11/1956 | France | 312/111 |
| 1381424 | 11/1964 | France | 312/270 |

*Primary Examiner*—Victor N. Sakran

*Attorney, Agent, or Firm*—Daniel T. Anderson

[57] ABSTRACT

A storage system for housing parts such as product packaging parts. The system includes a modular plurality of housings and a drawer for each housing. Each housing includes a top wall and two parallel side walls. The top wall has a plurality of alignment slots adjacent its side walls and alignment tabs extending along the lower portion of the side walls and registering with alignment slots of a housing disposed thereabove. Further, each housing has a recess on its top wall extending through a major portion of its length and a lateral rail extending opposite the recess from a side wall and arranged to fit the recess of a laterally adjacent housing. Alignment slots on the rail permit to interconnect lateral adjacent housings. Each drawer has a bottom wall and two side walls, as well as a front and rear wall. A handle is disposed on the front wall for removably inserting or withdrawing the drawer into or from one of the housings. This make is possible to interlock modularly a set of housings disposed one above the other, as well as a set of adjacent housings.

6 Claims, 19 Drawing Figures

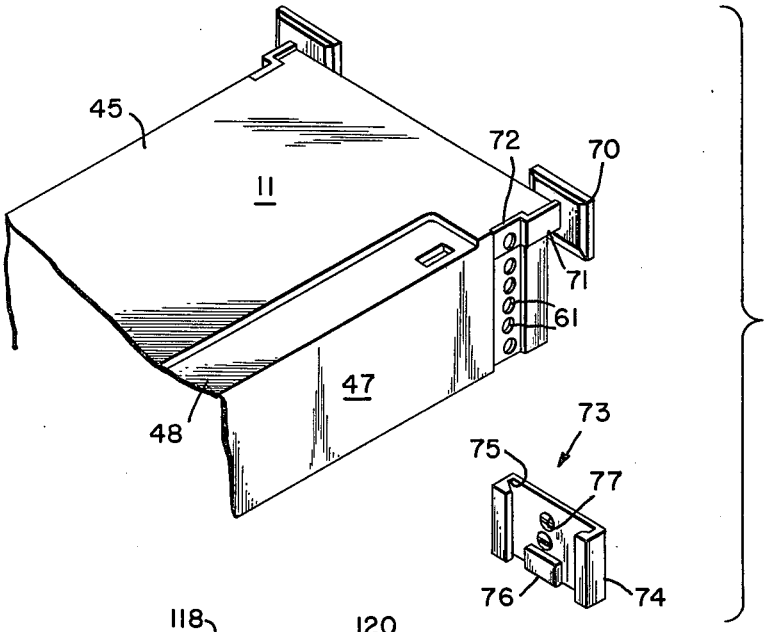
Fig. 4.
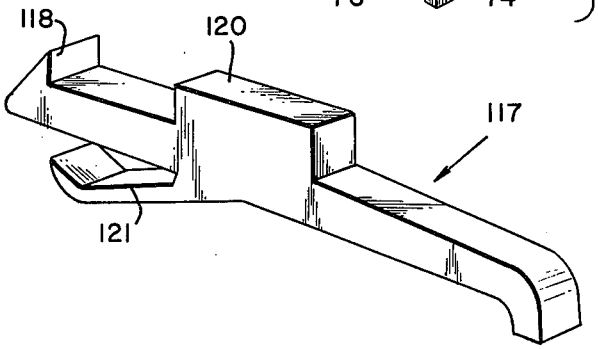
Fig. 18.
Fig. 19.
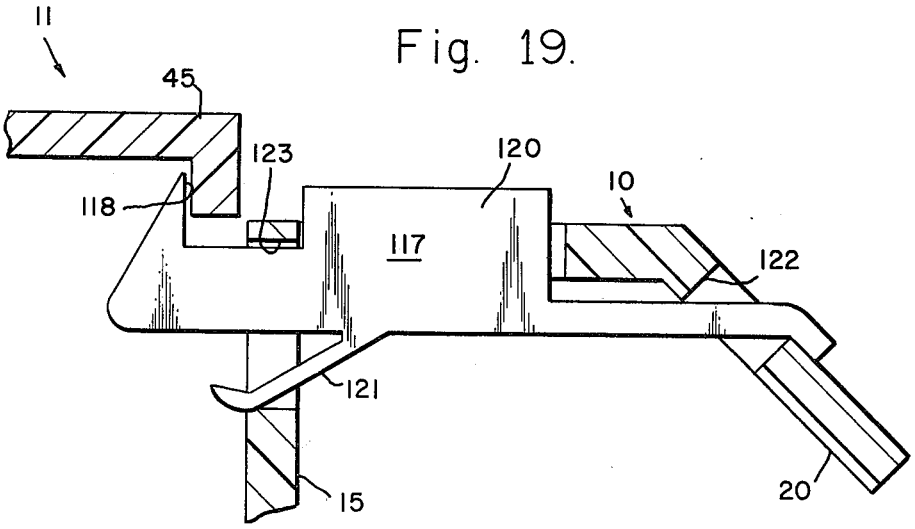

MODULAR STORAGE SYSTEM

This is a continuation of application Ser. No. 67,841, filed Aug. 20, 1979.

BACKGROUND AND SUMMARY OF THE INVENTION

The invention relates to a system for storing parts such as product packaging parts. The parts are maintained in a plurality of drawers, each being insertable into a housing. Preferably, housing and drawers are made of a strong, transparent plastic. This makes it possible to determine at a glance where a needed part is stored.

Housings and drawers form a modular system, that is they may be interconnected in such a manner that sets of housings and drawers may be superimposed or disposed adjacent to each other without the possibility of the sets separating from each other.

It is accordingly an object of the present invention to provide a storage system for product packaging parts which may easily and inexpensively be manufactured from a clear plastic.

Another object of the present invention is to provide such a system where sets, each consisting of a drawer and a housing, may be arranged on top of each other or adjacent to each other without the possibility of the sets separating laterally, vertically or sideways.

A further object of the present invention is to provide such a system where the drawers may be inserted each into its housing in either an upper position or in a lower position to accommodate larger parts.

It is still another object of the present invention to provide a removable cover so that when the drawer is in its lower position parts are prevented from falling out of the drawer.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

BRIEF DESCRIPTION OF THE DRAWINGS

FIG. 4 is an exploded view showing an adaptor bracket and a wall mount for mounting the housing to a wall;

FIG. 15 is a cross-sectional view similar to that of FIG. 13, but illustrating a universal mounting device for directly connecting a housing to the lower surface of a bench or the like;

FIG. 18 is a view in perspective of a modified and preferred locking device for locking and unlocking a drawer to a housing; and FIG. 19 is a cross-sectional view of a portion of a drawer and its associated housing with the modified locking device of FIG. 17 which is unlockable by depressing it against the force of the spring.

DESCRIPTION OF THE PREFERRED EMBODIMENTS

Figure 1:
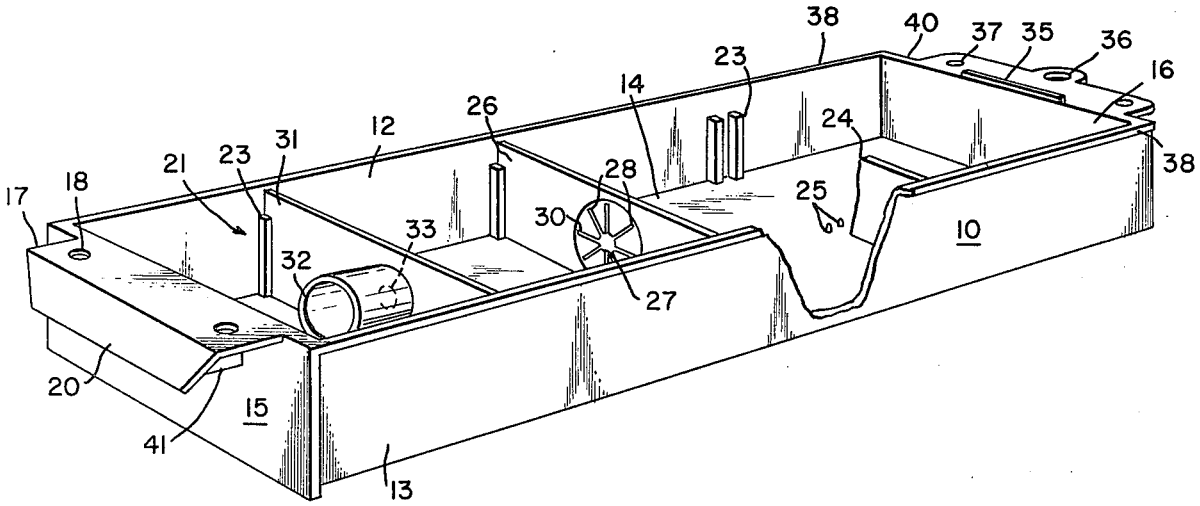
FIG. 1 is a view in perspective of a drawer in accordance with the present invention.
Figure 2:
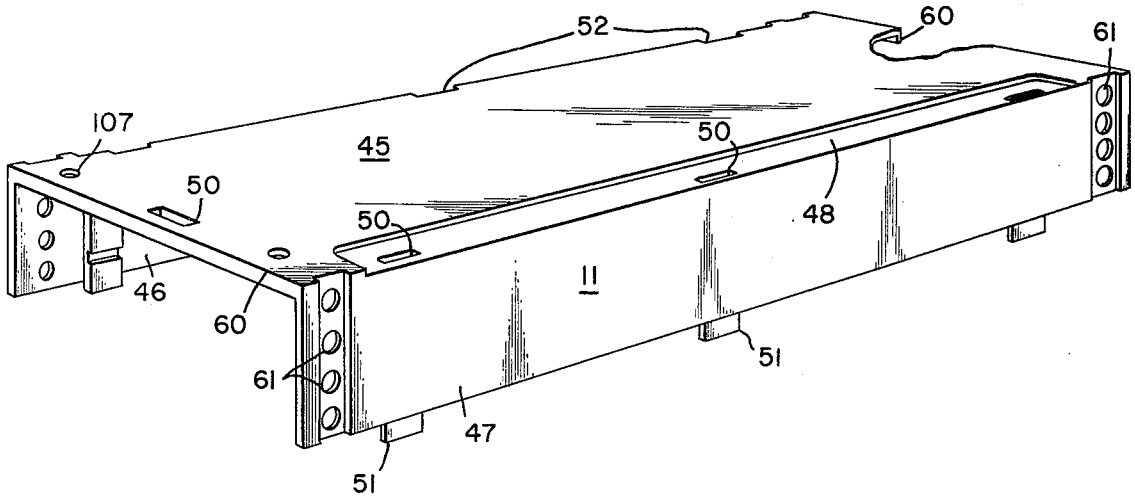
FIG. 2 is a view in perspective of a housing embodying the present invention.
Figure 3:
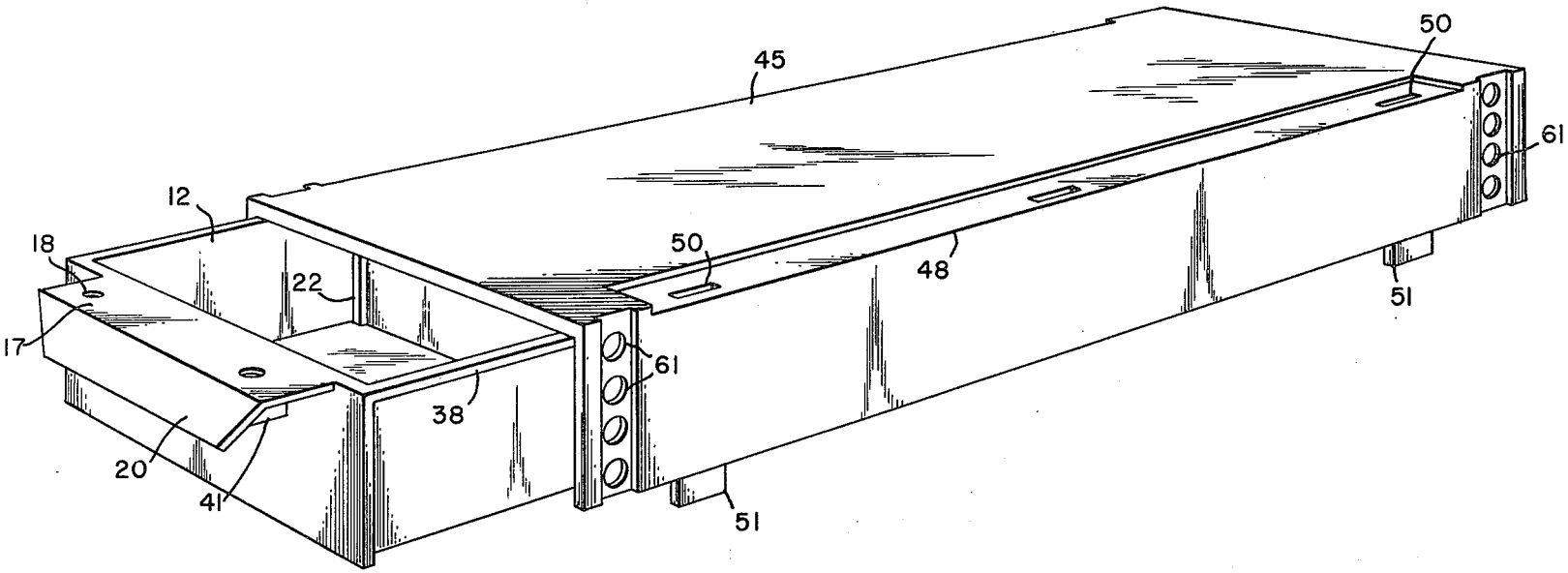
FIG. 3 is a view in perspective of a housing and a drawer extending partially from the housing.

Referring now to FIGS. 1—3, there is illustrated, by way of example, an embodiment of the present invention. This embodiment includes a drawer generally designated 10 and a housing indicated at 11. Drawer 10 and housing 11 are preferably injection molded from a transparent plastic material having structural integrity. The drawer 10 has two substantially parallel side walls 12 and 13, a bottom wall 14, a front wall 15 and a rear wall 16. The front wall 15 is provided with an upper horizontally extending portion 17 which may be provided with a pair of holes 18 for a purpose to be described subsequently. Extending at an angle forwardly is a portion 20 which forms a handle by means of which the drawer may be removed from its housing 11.

Disposed on each of the side walls 12 and 13 are sets of guides such as 21 which include two parallel ridges 22 and 23 between which a divider such as 24 may be positioned. The divider 24 is, of course, removable. In order to further aid the positioning of the dividers 24 there may be provided a set of projections 25 on the bottom wall 14 spaced apart by the width of the divider. Accordingly, the divider is supported by the two ridges 22, 23 on each side wall 12 and 13 and between two projections 25.

Instead of a flat divider 24, it is also feasible to utilize a divider such as shown at 26. This divider has a central substantially circular aperture 27 and radial slots 28 extending therefrom into a circle 30. This type of divider may be used for restraining parts which may extend slightly beyond the space between one of the front or rear walls and the divider 26.

Still another type of divider is shown at 31 which is provided with a forwardly extending cylinder 42 and a central hole 33. This may be used to retain cylindrical materials or a tool such as a certain type of soldering instrument.

The drawer 10 is further provided with a rearwardly extending horizontal projection 35 which is at the level of the top rim of the drawer. It may have a relatively large central opening 36 and two adjacent openings 37 for a purpose to be explained hereinafter.

Adjacent the top of both side walls 12 and 13 is a longitudinally extending lateral ridge 38 which fits a set of guides on the housing which will be subsequently explained.

Additionally the rear wall 16 of the drawer is provided with an upward extension 40 which forms a stop together with a corresponding ridge on the housing. A reinforcing portion 41 may interconnect the handle 20 to the forward extension 17 of the drawer.

Turning now to the modular housing 11 (FIG. 2), this is provided with a top wall 45 and two side walls 46 and 47. The top wall 45 is provided with a lateral depression 48 which extends over the larger part of the top wall 45 along one edge thereof. Extending through the depression 48 are several alignment slots 50 which are substantially equally spaced from each other. The depression 48 of a housing 11 fits into a laterally extending rail 57 of an upper adjacent housing (see FIG. 13). Corresponding to the alignment slots 50 is a set of alignment tabs 51 which are in line with the slots 50. The alignment tabs 51 extend downwardly from the side wall 11. Similar alignment slots 52 are disposed on the opposite side of the top wall 45, that is adjacent the side wall 46 together with corresponding alignment tabs not shown in FIG. 2.

Figure 9:
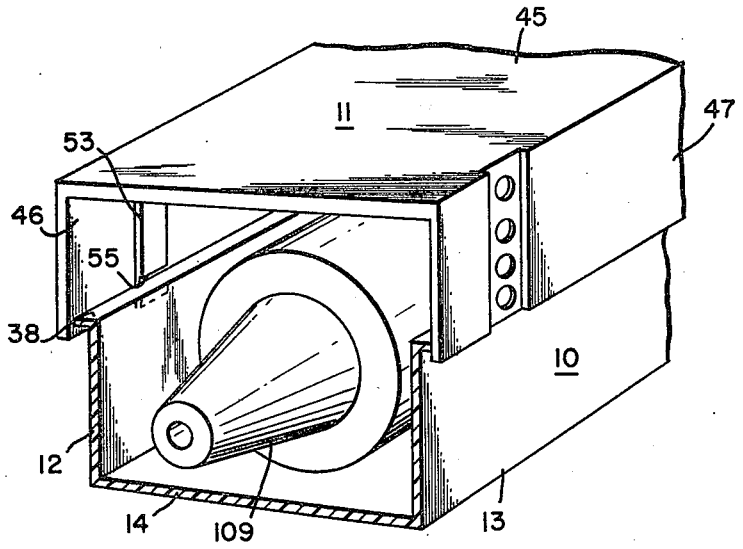
FIG. 9 is a view in perspective of a portion of a housing and drawer showing the drawer in its lower position to house a relatively large part.
Figure 10:
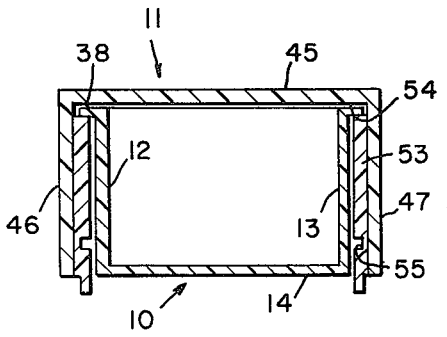
FIG. 10 is a cross-sectional view showing a housing and inserted drawer and illustrating two sets of guiding slots in the housing.

Disposed in line with the alignment slots 50 and 52 and tabs 51 are projections (see, for example, FIGS. 9 and 10) such as 53 on the two side walls 46 and 47 facing each other. These projections in turn are provided with two sets of guide slots, that is with an upper set 54 and a lower set 55 shown particularly in FIG. 10. The lateral ridges 38 of the drawer 10 fit into the guide slots 54 or 55 as shown in FIGS. 9 and 10.

Both the front and rear end of the top wall 45 of the housing 11 is provided with a downwardly extending ridge 60.

Additionally the two side walls 46 and 47 of the housing 11 are provided with a plurality of holes 61 adjacent to both front and rear portion of the side walls.

Referring now to FIG. 4, there is illustrated an adapter bracket and wall mount for mounting the housing 11 to a wall. Thus the adaptor bracket 70 may have an extension 71 which may be secured to one of the holes 61 by a fastener such as a rivet 72 or the like. The adaptor bracket 70 which is of generally rectangular construction, may be fitted or slid into a wall mount 73 having lateral walls 74 forming a recess or guide 75 into which the bracket 70 fits. The bracket in turn is retained by an extension 76 against which it fits. The wall mount may be secured to the wall, for example, by screws 77.

Figure 5:
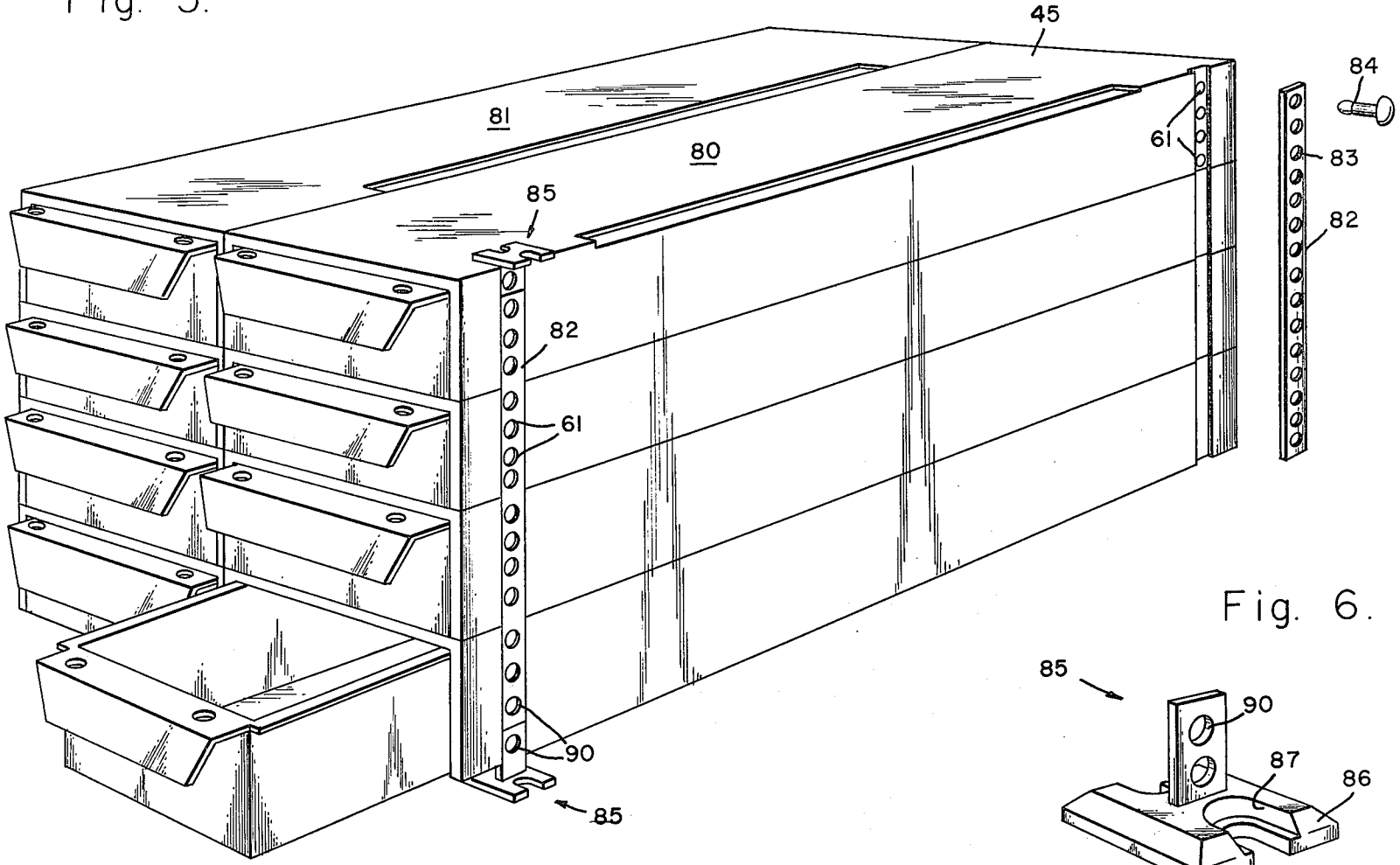
FIG. 5 is a view in perspective of a plurality of housings and drawers disposed adjacent to each other and on top of each other and including a flexible strap for interconnecting housings disposed on top of each other.

FIG. 5 illustrates two sets of drawers and housings 80 and 81. The set 80 is disposed one on top of the other and is interconnected by a flexible strap 82 which may, for example, consist of a suitable plastic and is provided with spaced holes 83. By means of fasteners such as so-called rivets 84 the plastic strap 82 may be secured to the holes 61 in the respective housings. This in turn will secure the set of housings 80 to each other.

Figure 6:
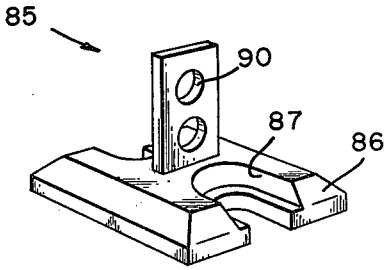
FIG. 6 is a view in perspective of a mounting foot having a plastic strap extending therefrom for securing it to a top and bottom housing as illustrated in FIG. 4.

Additionally, a mounting foot 85 may be utilized which is shown in FIG. 6. The mounting foot 85 has a platform 86 provided with two stepped slots 87. Extending vertically from the mounting foot 85 is a portion 88 provided with holes 90 which may in turn be secured to corresponding holes in one of the housings of the set 80. The foot 85 may be secured to the top wall 45 of the topmost housing. By means of one of the stepped slots 87 the structure may be secured by a suitable fastener.

Figure 7:
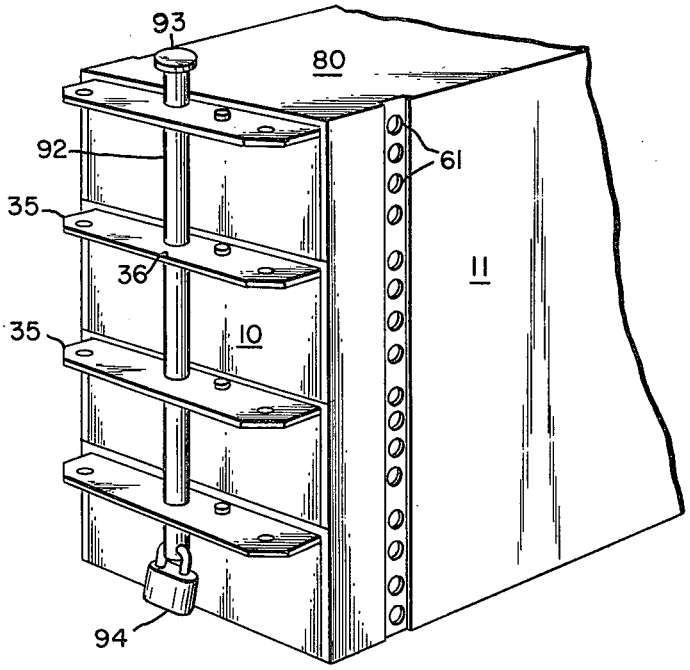
FIG. 7 is a view in perspective of the rear portion of a plurality of housings and drawers stacked on top of each other and including a locking rod and padlock for locking the drawers and for easy transport.

Referring now to FIG. 7, this again shows a set 80 of vertically aligned housings and drawers. The horizontal extension 35 of each drawer 10 is provided with a central aperture 36. A locking rod 92 may extend through the openings 36 of the set of drawers. The locking rod 92 may have a top button 93, so that it will not slide through the hole 36, and a padlock 94 at the other end. This will permit either to lock the drawers so that they cannot be opened or else to carry the assembly from place to place without the inadvertent opening of drawers and spilling of their contents.

Figure 8:
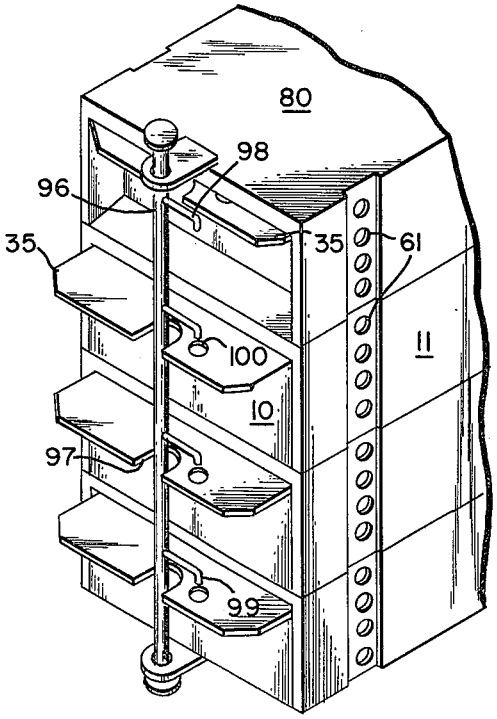
FIG. 8 is a view in perspective of a rear portion of a plurality of housings and drawers on top of each other and including a modified retainer rod for locking and unlocking the drawers.

A modified structure of this type is shown in FIG. 8. Here the stack of housings and drawers 80 may be locked by a retainer rod 96 which extends through a cutout 97 in the rear drawer wall 35. The retainer rod 96 may be provided with L-shaped extensions 98 having a downwardly extending portion which in turn may slide into openings 100 in the horizontal wall 35 of the drawers. Thus by lifting the retainer rod 96 the drawers may be released because the L-shaped portion 98 disengages the holes 100. However, when the L-shaped rod portion 98 engages the holes 100 the drawers are locked so they can be moved.

The drawer 10 may be inserted into the housing 11 in two different positions. This has been illustrated in FIGS. 9 and 10. The upper lateral ridges 38 of the drawer 10 are slidable in two sets of guide slots 54 and 55 of the projections 53 inside the housing walls 46 and 47. FIG. 9 shows the drawer 10 in its lower position to accommodate a relatively large part 109. FIG. 10 illustrates more clearly the two sets of guide slots 54 and 55.

Figure 11:
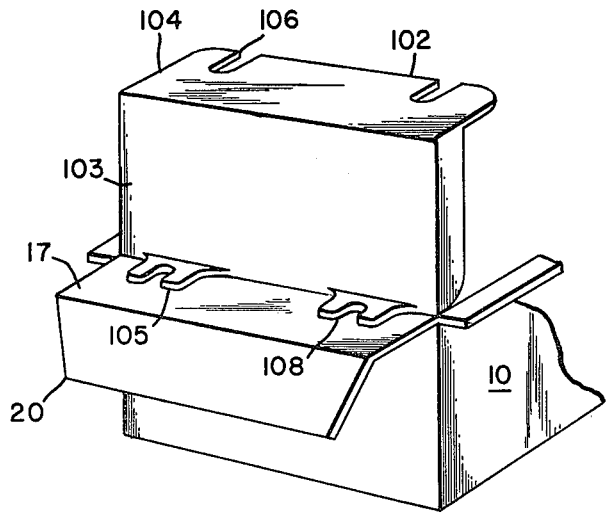
FIG. 11 is a view in perspective of an enclosure member for locking a drawer in the position of FIG. 9.

When the drawer 10 is in its lower position shown in FIG. 9 provision may be made so that its contents are secured from sliding out of the drawer. This has been illustrated in FIG. 11, to which reference is now made, which illustrates a closure member 102 which may be utilized when the drawer 10 is in the position shown in FIG. 9. The closure member 102 includes a vertical wall portion 103, a top portion 104 and a bottom portion 105. The top portion 104 is provided with two cutouts 106 which in turn match the holes 107 (see FIG. 2) in the top wall 45 of the housing 11. On the other hand, the lower wall 105 is also provided with projections 108 which in turn may be locked to the holes 18 (see FIG. 1) in the drawer 10. The parts may be locked by split rivets or similar conventional fastener devices.

Figure 12:
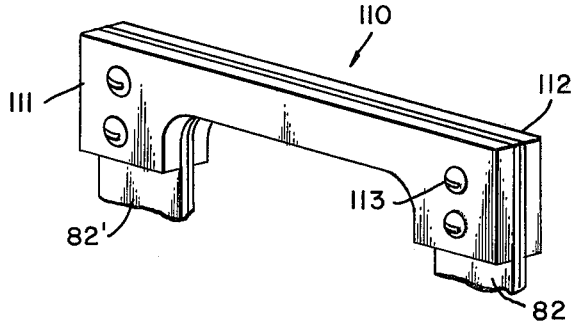
FIG. 12 is a view in perspective of a two-part handle for carrying a set of adjacent housings and drawers by means of the strap interconnecting the housings.

FIG. 12 illustrates a handle 110 consisting of two portions 111 and 112 which may be connected by appropriate fastening means such as screws 113. The handle 110 may be connected to the two sets 80 and 81 of FIG. 5 for handcarrying them by respective flexible straps 82 and 82' from the respective sets 80 and 81. In this case the handle 110 may be disposed parallel to the housing side walls 46, 47.

Figure 13:
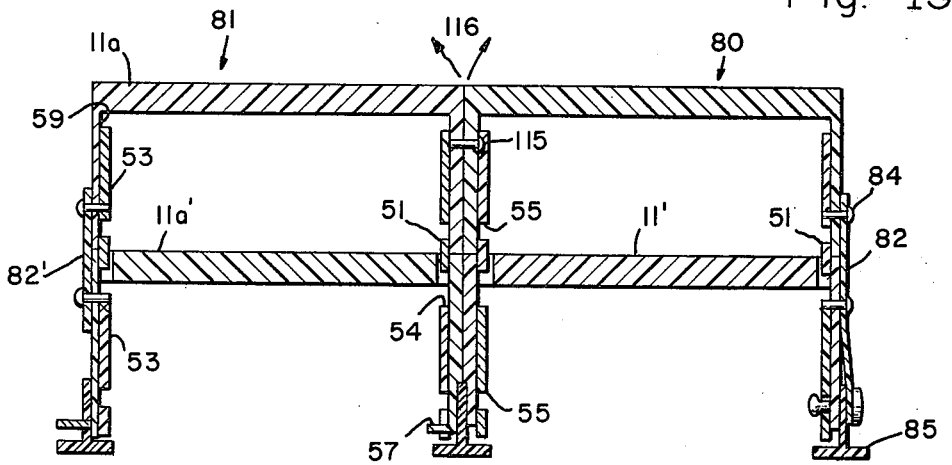
FIG. 13 is a cross-sectional view showing four housings, two disposed on top of each other and the other two adjacent the first set to illustrate how the housings are interlocked to prevent motion up and down, as well as sideways or separating motions between the housings.

FIG. 13 illustrates two sets of housings and drawers 80 and 81. Each set 80 and 81 consist of two housings and drawers and the two sets are disposed adjacent to each other. The flexible straps 82 interconnect housings 11 and 11' of set 80; and the straps 82' interconnect housings 11*a* and 11*a*' of set 81 to each other. Both straps 82, 82' are jointly clamped between portions 102 and 103. This will prevent housings 11 and 11' from separating, as well as housings 11*a* and 11*a*'. The alignment tabs such as 51 again lock housings 11 and 11' as well as housings 11*a* and 11*a*' so that they cannot move relative to assemblies 80 and 81. Finally, push pins or rivets 115 extending between housings 11 and 11*a* prevent housings 11 and 11*a* from moving respectively to the right and to the left of each other as shown by the arrows 116.

Thus, it will be seen that assemblies 80 and 81 are prevented from moving relative to each other. This is effected by the alignment tabs 51, the flexible straps 82, 82' and the push pins 115.

Figure 14:
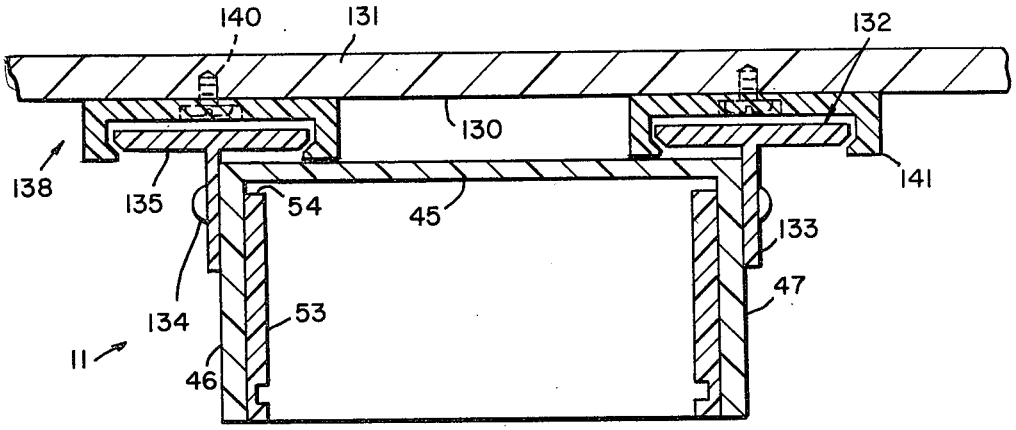
FIG. 14 is a cross-sectional view of a housing and showing a mounting foot and retainer guide therefor secured to the lower surface of a bench.
Figure 15:
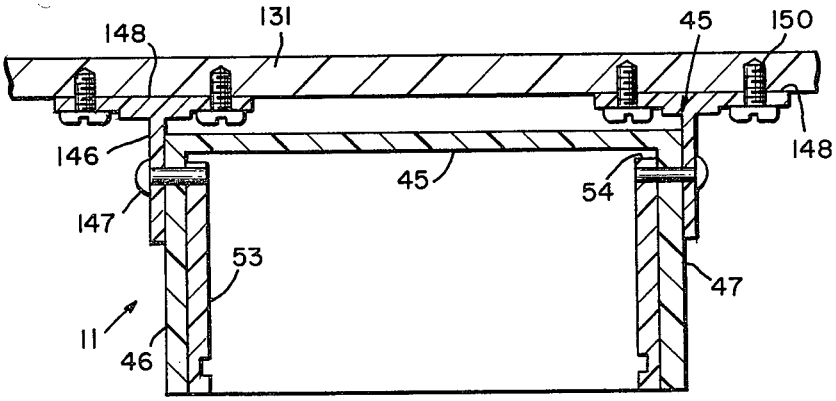

FIGS. 14 and 15 illustrate two different methods of securing a housing 11 to the lower surface 130 of a horizontal shelf 131 such as that of a work bench. As illustrated in FIG. 14 a T-shaped mounting foot 132 has a depending portion 133 which may be secured to the side wall 46 or 47 or the drawer 11 by a locking pin 134 or the like. Each of the horizontal runner portions 135 of the T-shaped feet 132 have a sliding fit within a respective retainer guide set 138, 141. The retainer guide set 138, 141 is secured to the lower bench surface 130 by screws 140.

FIG. 15 shows a single universal mounting foot 145 which has a depending portion 146 secured to the housing side walls 46 or 47 by locking pins 147. The horizontal top portion 148 of the mounting foot is secured to the lower bench surface 130 by screws 150.

Figure 17:
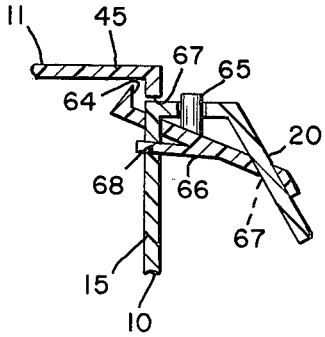
FIG. 17 is a sectional view of a portion of a housing and drawer showing the locking device of FIG. 16 in a locked position.
Figure 16:
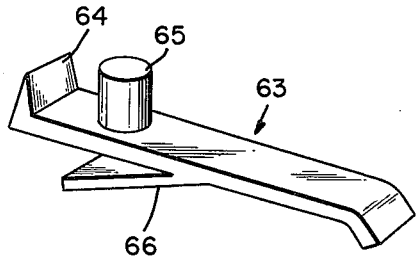
FIG. 16 is a view in perspective of a locking device for locking and unlocking a drawer to a housing.

As shown particularly in FIG. 16, there may be provided a locking device 63 of generally rectangular cross-section. The locking device 63 is provided with a wedge-shaped locking stop 64 and an upwardly extending and locking button 65. Extending from the lower surface of the device 63 there is a leaf spring like projection 66. The wedge-shaped stop 64 engages the ridge 60 of the housing as shown in FIG. 17. The device extends through a substantially rectangular cutout 67 in the drawer 10. By pressing on the button 65 against the force of spring 66 which in turn extends through an opening 68 in the drawer front wall 15, the locking stop 64 is disengaged and hence the drawer may be removed.

Referring now to FIGS. 18 and 19, there is illustrated another variation of a locking device for locking a drawer 10 to a housing 11. However, the locking device illustrated in FIGS. 16 and 17 is presently a preferred one. As shown in FIG. 18 the locking device 117 again has a locking jaw or wedge 118 at its front end. It is provided with a rectangular shaped raised extension 120 for depressing it against the action of a spring 121. The locking device 117 extends through a cutout 122 in the handle 20 of the drawer 10. It also extends through another cutout 123 in the front wall 15 of the drawer 10. The locking jaw 118 engages the ridge 60, the raised extension 120 against the force of spring 121, the locking jaw 118 is disengaged and the drawer may be opened. This provides a finger release lock for the drawer.

There has thus been disclosed a system for storing parts such as product packaging parts. The system includes a modular set each consisting of a housing and a drawer. The sets may be put on top of each other and/or adjacent to each other. Means are provided for locking each housing to an adjacent housing and for restraining sets of superimposed housings. Also, two adjacent sets of housings are locked together to prevent lateral separation. Both housing and drawer are made of transparent plastic and are hence inexpensively manufactured. The drawers may be provided with different types of removeable dividers. The drawers may be inserted into an upper or lower portion into the housing. In the latter case, a closure member may be provided to close the opening formed between the housing and the drawer.

What is claimed is:

1. A modular storage system for product packaging parts comprising:
   (a) a plurality of housings;
   (b) a drawer for each of said housings;
   (c) each of said housings including a top wall and two parallel side walls, said top wall having a plurality of alignment slots adjacent said side walls, alignment tabs extending downwardly from said side walls and registering with alignment slots of a housing thereabove;
   (d) each of said housings having on its top wall a recess and having on the bottom of the side wall opposite said recess a lateral rail extending therefrom and adapted to fit the recess of a laterally adjacent housing, and alignment slots on said rail; and
   (e) each of said drawers having a bottom wall and two side walls, a front wall including a portion for removably inserting or withdrawing said drawer into or from one of said housings, and a rear wall including a horizontally projecting surface having an upward projection to cooperate with a downwardly extending ridge on the end of the top wall of said housing, thereby to form a stop.

2. A modular storage system for product packaging parts comprising:
   (a) a plurality of housings;
   (b) a drawer for each of said housings;
   (c) each of said housings including a top wall and two parallel side walls, said top wall having a plurality of alignment slots adjacent said side walls, alignment tabs extending downwardly from said side walls and registering with alignment slots of a housing thereabove;
   (d) each of said housings having on its top wall a recess and having on the bottom of the side wall opposite said recess a lateral rail extending therefrom and adapted to fit the recess of a laterally adjacent housing, and alignment slots on said rail; and
   (e) each of said drawers having a bottom wall and two side walls, a front wall including a portion for removably inserting or withdrawing said drawer into or from one of said housings, and a rear wall; and
   (f) the front wall of said drawer being provided with a substantially rectangular cutout and a locking member of substantially rectangular cross-section having an upwardly extending stop engageable with a downwardly extending ridge on the front end of the top wall of said housing, said locking member being provided with an actuating member extending through said cutout and spring means thereon whereby pressure on said stop member will disengage said locking member from said housing.

3. A modular storage system for product packaging parts comprising:

(a) a plurality of housings;

(b) a drawer for each of said housings;

(c) each of said housings including a top wall and two parallel side walls, said top wall having a plurality of alignment slots adjacent said side walls alignment tabs extending downwardly from said side walls and registering with alignment slots of a housing thereabove;

(d) each of said housings having on its top wall a recess and having on the bottom of the side wall opposite said recess a lateral rail extending therefrom and adapted to fit the recess of a laterally adjacent housing, and alignment slots on said rail;

(e) each of said drawers having a bottom wall and two side walls, a front wall including a portion for removably inserting or withdrawing said drawer into or from one of said housings, and a rear wall;

(f) a plurality of holes provided in alignment on the side walls of said housing, each set of holes extending substantially adjacent to the front and rear portions of said housing;

(g) a flexible strap provided with holes and registering with said holes in said side walls;

(h) fasteners extending through said holes on said flexible strap and said holes in said side walls, thereby to interconnect a plurality of housings stacked on top of each other; and (i) a plurality of mounting feet each having a stepped slot on opposite sides thereof for securing said foot to a top wall of a housing, said foot having extending therefrom a tab provided with means for connection through said holes to said housing.

4. A modular storage system for product packaging parts comprising:

(a) a plurality of housings;

(b) a drawer for each of said housings;

(c) each of said housings including a top wall and two parallel side walls, said top wall having a plurality of alignment slots adjacent said side walls, alignment tabs extending downwardly from said side walls and registering with alignment slots of a housing thereabove;

(d) each of said housings having on its top wall a recess and having on the bottom of the side wall opposite said recess a lateral rail extending therefrom and adapted to fit the recess of a laterally adjacent housing, and alignment slots on said rail;

(e) each of said drawers having a bottom wall and two side walls, a front wall including a portion for removably inserting or withdrawing said drawer into or from one of said housings, and a rear wall; and (f) said drawer being provided with a member horizontally extending from said rear wall thereof, said member having a central opening and at least one adjacent opening; and (g) a locking rod provided with an L-shaped extension to fit said lateral hole, whereby said locking rod may be utilized for interlocking a plurality of drawers disposed one on top of the other.

5. A modular storage system for product packaging parts comprising:

(a) a plurality of housings;

(b) a drawer for each of said housings;

(c) each of said housings including a top wall and two parallel side walls, said top wall having a plurality of alignment slots adjacent said side walls, alignment tabs extending downwardly from said side walls and registering with alignment slots of a housing thereabove;

(d) each of said housings having on its top wall a recess and having on the bottom of the side wall opposite said recess a lateral rail extending therefrom and adapted to fit the recess of a laterally adjacent housing, and alignment slots on said rail;

(e) each of said drawers having a bottom wall and two side walls, a front wall including a portion for removably inserting or withdrawing said drawer into or from one of said housings, and a rear wall; and (f) a separate closure element having a front wall and a top wall, said top wall having two cutouts for interconnecting it with corresponding holes in the front portion of the top wall of said housing and said cover having two rear-wardly extending extensions with cutouts for connection to a horizontal portion of the front wall of said drawer, whereby said cover may be connected to said holes by fastener means.

6. A modular storage system for product packaging parts comprising:

(a) a plurality of housings;

(b) a drawer for each of said housings;

(c) each of said housings including a top wall and two parallel side walls, said top wall having a plurality of alignment slots adjacent said side walls, alignment tabs extending downwardly from said side walls and registering with alignment slots of a housing thereabove;

(d) each of said housings having on its top wall a recess and having on the bottom of the side wall opposite said recess a lateral rail extending therefrom and adapted to fit the recess of a laterally adjacent housing, and alignment slots on said rail;

(e) each of said drawers having a bottom wall and two side walls, a front wall including a portion for removably inserting or withdrawing said drawer into or from one of said housings, and a rear wall; and (f) a locking device for locking said drawer to said housing, said drawer having a cutout for passing said locking device therethrough and a slot in the front wall of said drawer, said locking device having a retaining portion engageable with a downwardly extending region on the front wall of said housing and spring means on said locking device for normally causing engagement between said locking portion and said region and for disengaging said locking device against the pressure of said spring means.

* * * * *